US007746303B2

(12) United States Patent
Cernasov et al.

(10) Patent No.: US 7,746,303 B2
(45) Date of Patent: Jun. 29, 2010

(54) METHOD AND APPARATUS FOR EXTENDING THE COLOR DEPTH OF DISPLAYS

(75) Inventors: Andrei Cernasov, Ringwood, NJ (US); Fernando R. De La Vega, Ridgefield, NJ (US); Donald J. Porawski, Cedar Grove, NJ (US)

(73) Assignee: Honeywell International Inc., Morristown, NJ (US)

( * ) Notice: Subject to any disclaimer, the term of this patent is extended or adjusted under 35 U.S.C. 154(b) by 1257 days.

(21) Appl. No.: 11/280,284

(22) Filed: Nov. 17, 2005

(65) Prior Publication Data

US 2007/0109251 A1 May 17, 2007

(51) Int. Cl.
*G09G 3/36* (2006.01)

(52) U.S. Cl. ..... 345/88; 345/87; 345/99; 345/212; 345/213

(58) Field of Classification Search ..... 345/76–84, 345/87–104, 204–215
See application file for complete search history.

(56) References Cited

U.S. PATENT DOCUMENTS 5,389,948 A 2/1995 Liu
5,572,341 A 11/1996 Fergason
5,649,083 A 7/1997 Barkans et al.
5,712,657 A 1/1998 Eglit et al.
5,714,974 A 2/1998 Liu
5,715,029 A 2/1998 Fergason
5,748,163 A 5/1998 Han
5,757,347 A 5/1998 Han
5,905,504 A 5/1999 Barkans et al.
6,008,794 A 12/1999 Ishii
6,184,969 B1 2/2001 Fergason
6,362,834 B2 3/2002 Ishii
6,469,708 B1 10/2002 Wu et al.
6,606,166 B1 8/2003 Knoll
6,801,213 B2 10/2004 Bergstrom et al.
6,816,141 B1 11/2004 Fergason
6,839,387 B1 1/2005 Mittel
6,844,882 B1 1/2005 Clauson
6,864,870 B2 3/2005 Kim et al.
7,358,929 B2 * 4/2008 Mueller et al. ..... 345/1.3
7,450,084 B2 * 11/2008 Fuller et al. ..... 345/1.1
2002/0000994 A1 1/2002 Bergstrom et al.
2002/0005831 A1 1/2002 Ishii
2002/0005854 A1 1/2002 Deering et al.
2002/0147861 A1 10/2002 Bui et al.
2003/0030611 A1 2/2003 Kim et al.
2003/0122847 A1 7/2003 Donovan et al.
2003/0179393 A1 9/2003 Huovinen
2003/0201990 A1 * 10/2003 Aldrich et al. ..... 345/211
2004/0036799 A1 2/2004 Weitbruch et al.
2004/0056983 A1 3/2004 Dean et al.
2004/0165162 A1 8/2004 Peter et al.
2005/0021579 A1 1/2005 Bae et al.

* cited by examiner

OTHER PUBLICATIONS

H. De Lange Dzn, "*Relationship between Critical Flicker-Frequency and a Set of Low-Frequency Characteristics of the Eye*," Journal of the Optical Society of America, May 1954, vol. 44, No. 5, pp. 380-389.

*Primary Examiner*—Vijay Shankar
(74) *Attorney, Agent, or Firm*—Ingrassia Fisher & Lorenz, P.C.

(57) ABSTRACT

A method of extending color depth in a display includes determining pixel sub-intervals for pixel intervals in a video signal, modulating a transmissivity of a display panel of the display from one sub-interval to another sub-interval, and modulating backlight intensity of a backlight from the one sub-interval to the another sub-interval.

20 Claims, 14 Drawing Sheets

--PRIOR ART--

METHOD AND APPARATUS FOR EXTENDING THE COLOR DEPTH OF DISPLAYS

FIELD

Embodiments generally relate to methods and apparatus of displaying video.

BACKGROUND

Ideally, video displays such as a liquid crystal display ("LCD") should have the ability to render continuously varying tones of all three primary colors, for example, red, green, and blue. As such, each pixel of the display would be able to generate an infinite number of colors and intensities as linear combination of the primary colors. However, a number of factors such as display physics, display memory size, driver limitations, and so on reduce the number of available color intensities.

Conventional LCDs comprise a backlight, polarization filters, other optical filters, and a liquid crystal panel which includes liquid crystal ("LC") cells. In a liquid crystal panel, a pixel is composed of three neighboring LC cells, one for each primary color. In an LCD, a pixel's color and intensity is determined by the voltages applied to its three neighboring LC cells. Particularly, the light transmittance of each cell is a function of the voltage applied across the cell. Finally, the backlight and color filters give the otherwise monochrome cells red, green, and blue colors. The backlight may be constructed of cold cathode fluorescent lamps ("CCFL") or light emitting diode ("LED") arrays with optional light piping. The LCD may also include a diffuser screen to disperse the light.

For a thin-film transistor ("TFT") LCD panel, the voltage for each LC cell is generated by a digital to analog converter ("DAC"). The voltage is strobed onto a local capacitor via a local transistor uniquely associated with that LC cell. Each LC cell must be refreshed at least at the field or frame rate of the LCD. Typical LCDs may include 6 bit DACs, which would be able to produce a total palette of 262,164 colors. More costly units may include 8 bit DACs, which would be able to produce a total palette of 16,777,216 colors. As such, large LCDs require large numbers of DACs. Moreover, due to complexity, the size of each DAC increases as the bit capacity of the DAC increases. 7 bit DACs are almost twice as large as 6 bit DACs, and 8 bit DACs are twice as large as 7 bit DACs.

In addition to information related to color, additional bits are needed to support gamma-like corrections and to zero out the local LC cell capacitor bias over the applicable temperature range. With current technology, LCDs are controlled using a total of 64 voltage levels, although, more costly LCDs may use 256 voltage levels. Nonetheless, other techniques such as spatial or temporal dithering may be used to extend the color depth and intensity range of LCDs.

Temporal dithering involves updating pixels a number of times within each pixel period. FIG. 1 illustrates an example of temporal dithering. As shown in FIG. 1, the backlight of a panel produces a uniform intensity $I_0$ (graph 101). Each pixel interval is divided into four sub-periods T, 2T, 3T, and 4T. Each pixel is assumed to be driven by the output of a DAC either at the $Tr_n$ level or the next higher level $Tr_{n+1}$ with the separation being δTr. Transitions may only occur at the T, 2T, 3T, or 4T markers defining the four sub-intervals of the pixel period. The transistor applies $Tr_{n+1}$ to an LC cell, the higher voltage for one, two, or three subintervals and $Tr_n$ for the balance (graphs 102, 104, 106, 108, and 110). The human eye typically integrates the pixel's output to three intermediate values. For example, as shown in panel 104, $Tr_{n+1}$ is applied for sub-period T. As a result, the effective transmittance for the LC cell is $Tr_n$+0.25 δTr and the pixel intensity is $I_0(Tr_n+0.25\ \delta Tr)$.

Thus, by varying transmittance during the sub-periods, three extra gray shades per color are generated which produces a de-facto increase in the display color depth. However, by only getting three extra gray shades per color, the full potential of the four extra bits used by the dithering process is not being utilized.

SUMMARY

Embodiments of the invention concern a method of extending color depth in a display. The method comprises determining pixel sub-intervals for pixel intervals in a video signal, modulating a transmissivity of a display panel of the display from one sub-interval to another sub-interval, and modulating backlight intensity of a backlight from the one sub-interval to the another sub-interval.

Embodiments also concern another method of extending color depth in a display. The method comprises determining pixel sub-intervals for pixel intervals in a video signal, determining a light source modulation for the pixel sub-intervals, modulating intensity of a light source based on the light source modulation, and synchronizing a transmittance of a display panel of the display with the light source modulation for each sub-interval.

Embodiments also concern a display with extended color depth. The display comprises a light source, a light source driver coupled to the light source, a display panel disposed adjacent to the light source, a display panel control circuit coupled to the display panel, and a dithering circuit coupled to the light source driver and display panel control circuit. The dithering circuit also comprises logic for determining pixel sub-intervals for pixel intervals in a video signal, logic for modulating a transmissivity of the display panel from one subinterval to another sub-interval, and logic for modulating light source intensity from the one sub-interval to the another sub-interval.

Additional embodiments will be set forth in part in the description which follows, and in part will be obvious from the description, or may be learned by practice of the invention. The embodiments will be realized and attained by means of the elements and combinations particularly pointed out in the appended claims.

It is to be understood that both the foregoing general description and the following detailed description are exemplary and explanatory only and are not restrictive of the invention, as claimed.

The accompanying drawings, which are incorporated in and constitute a part of this specification, illustrate several embodiments and together with the description, serve to explain the principles of the invention.

DETAILED DESCRIPTION

Embodiments of the invention concern methods and apparatus for extending the color depth in a display. In typical four bit dithering technique in which a uniform light source is used, the color depth may be extended by three extra gray shades per color.

According to embodiments of the invention, color depth is increased by modulating the light source of the display and synchronizing the dithering of each pixel with the modulation of the light source. The light source may be modulated by changing the intensity of the light source for different sub-intervals of the pixel interval. Then, the dithering of each pixel is synced with the modulated light source for the different sub-intervals.

By modulating the light source, the range of colors produced during dithering can be increased. The method allows increased color depth using hardware currently found in displays without increasing the size and cost of the display. For example, using four bit dithering and different modulation functions for the light source, nine extra gray shades per color are generated which produces a de-facto increase in the display color depth from 256K to over 251 million colors, or fourteen extra gray shades per color are generated which produces a de-facto increase in the display color depth from 256K to over 846 million.

Reference will now be made in detail to embodiments of the invention, examples of which are illustrated in the accompanying drawings. Wherever possible, the same reference numbers will be used throughout the drawings to refer to the same or like parts.

Figure 1:
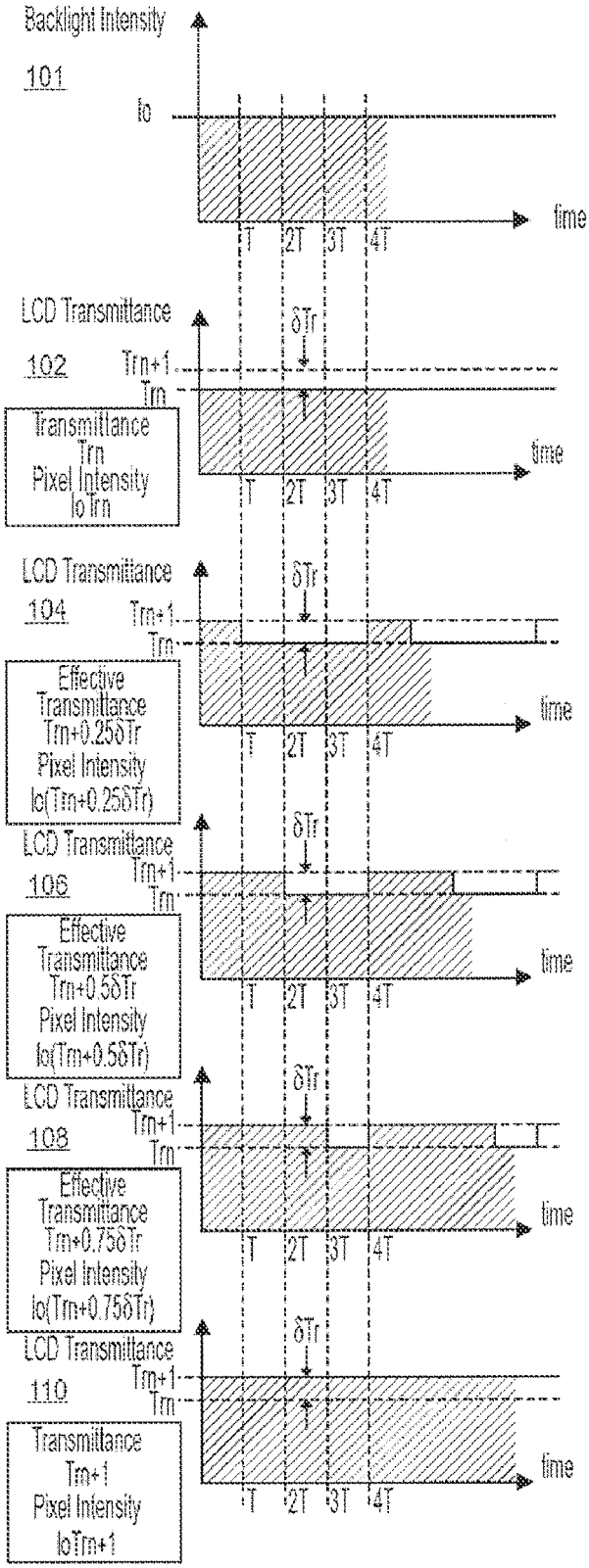
FIG. 1 is a diagram illustrating a method of temporal dithering.
Figure 2:
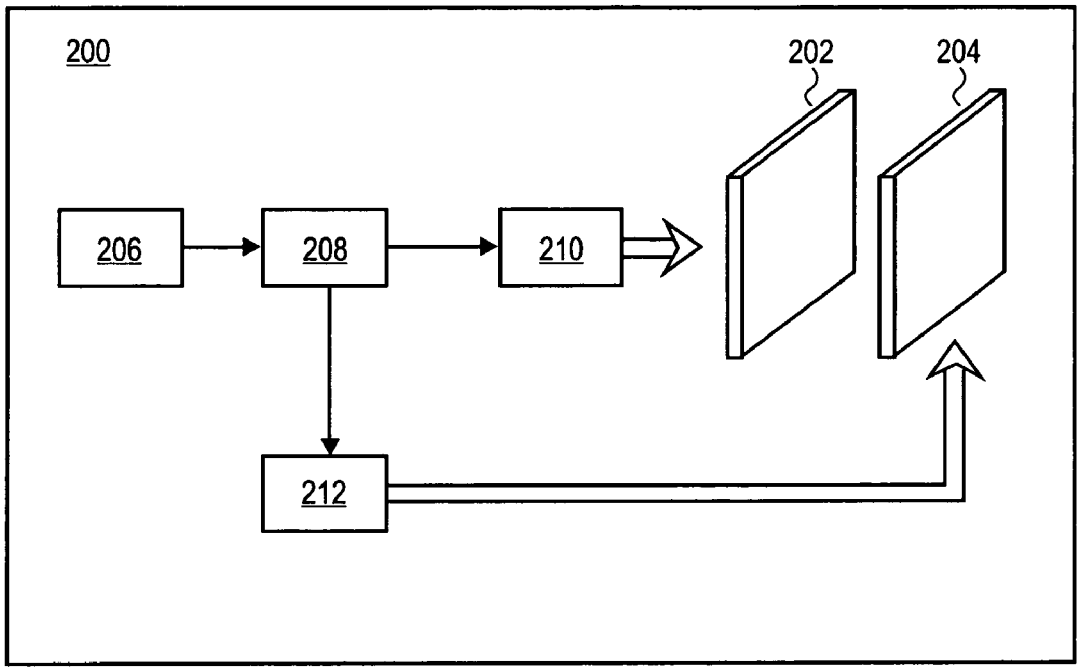
FIG. 2 is a diagram illustrating a display consistent with embodiments.
Figure 3A:
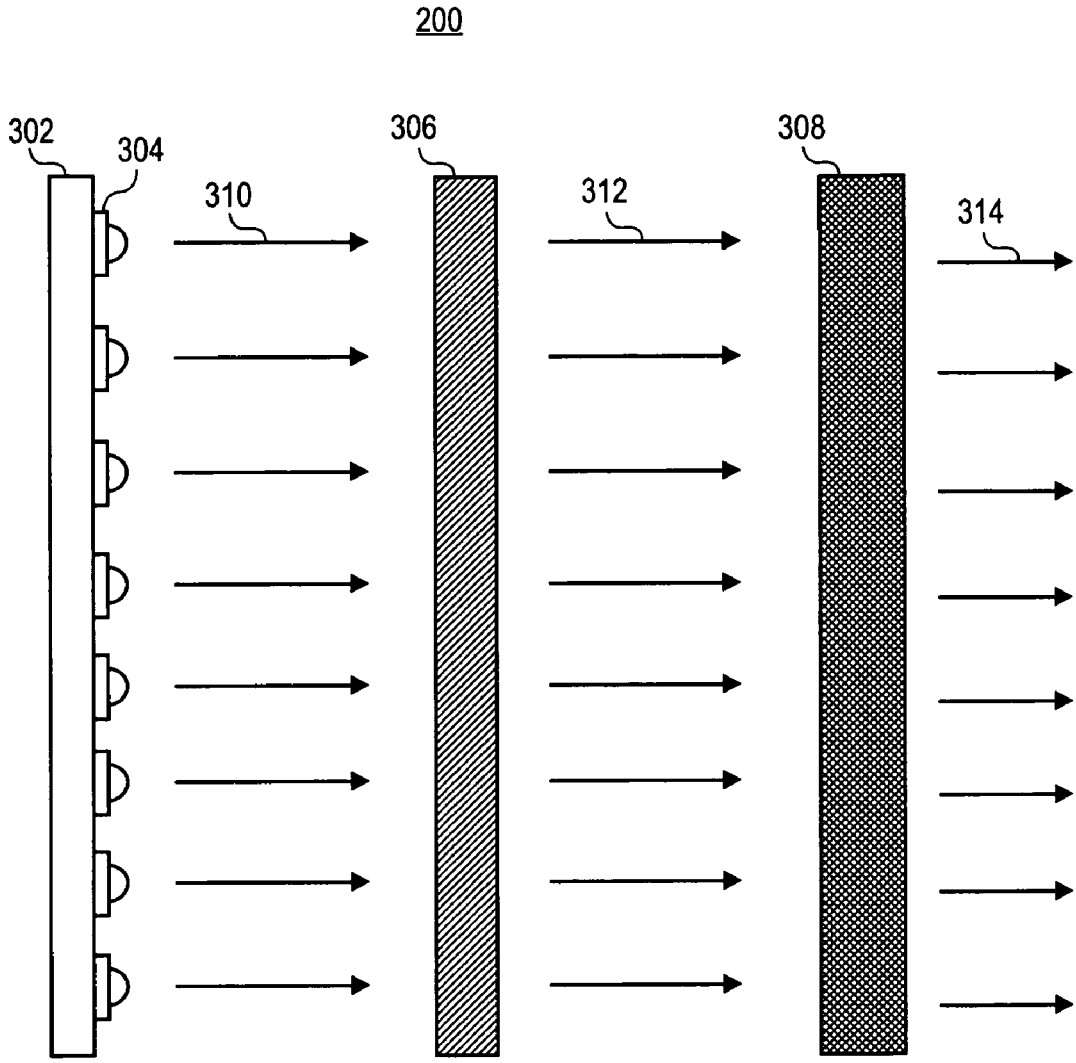
FIG. 3A-D are diagrams illustrating parts of a display consistent with embodiments.
Figure 3B:
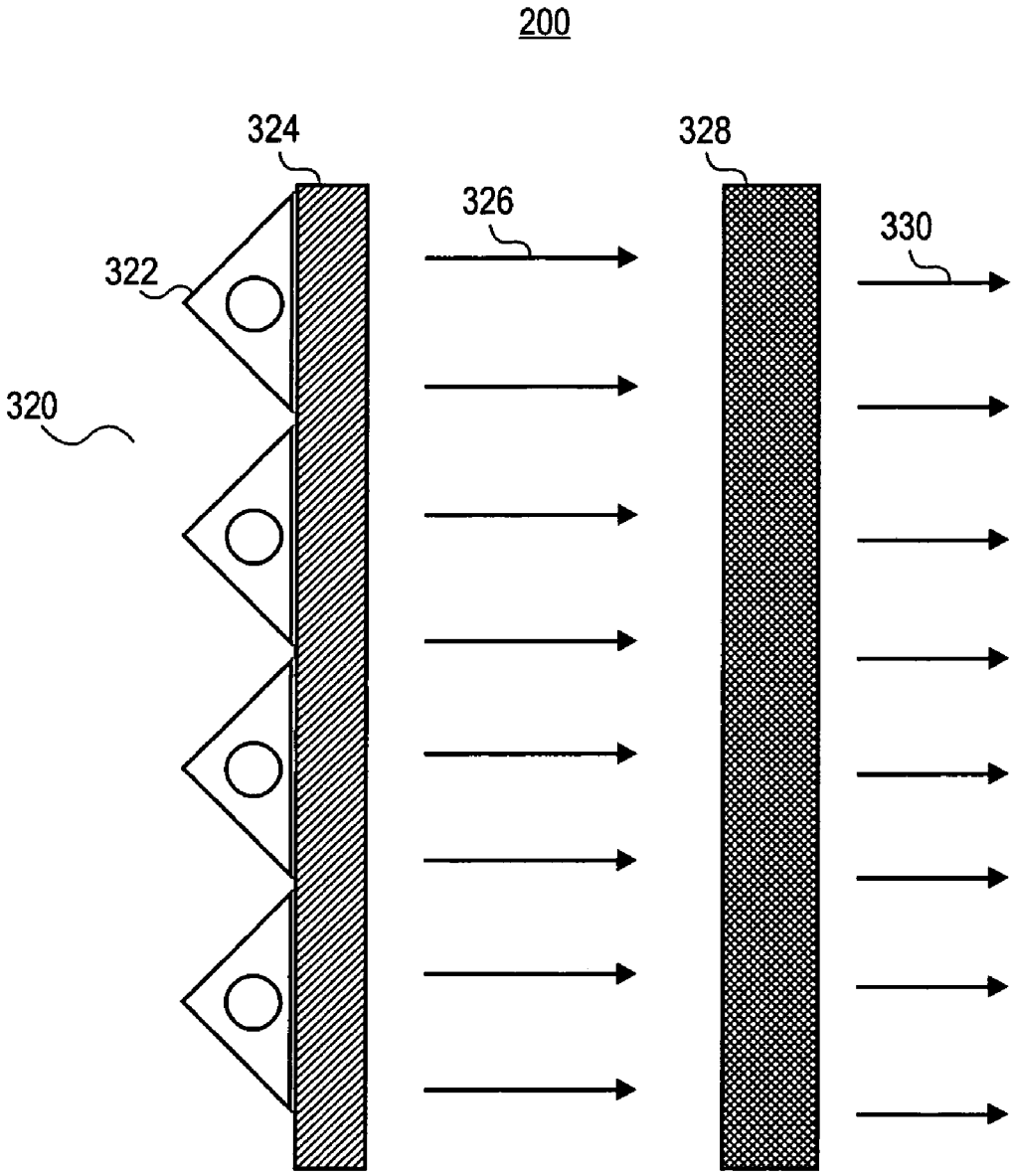
Figure 3C:
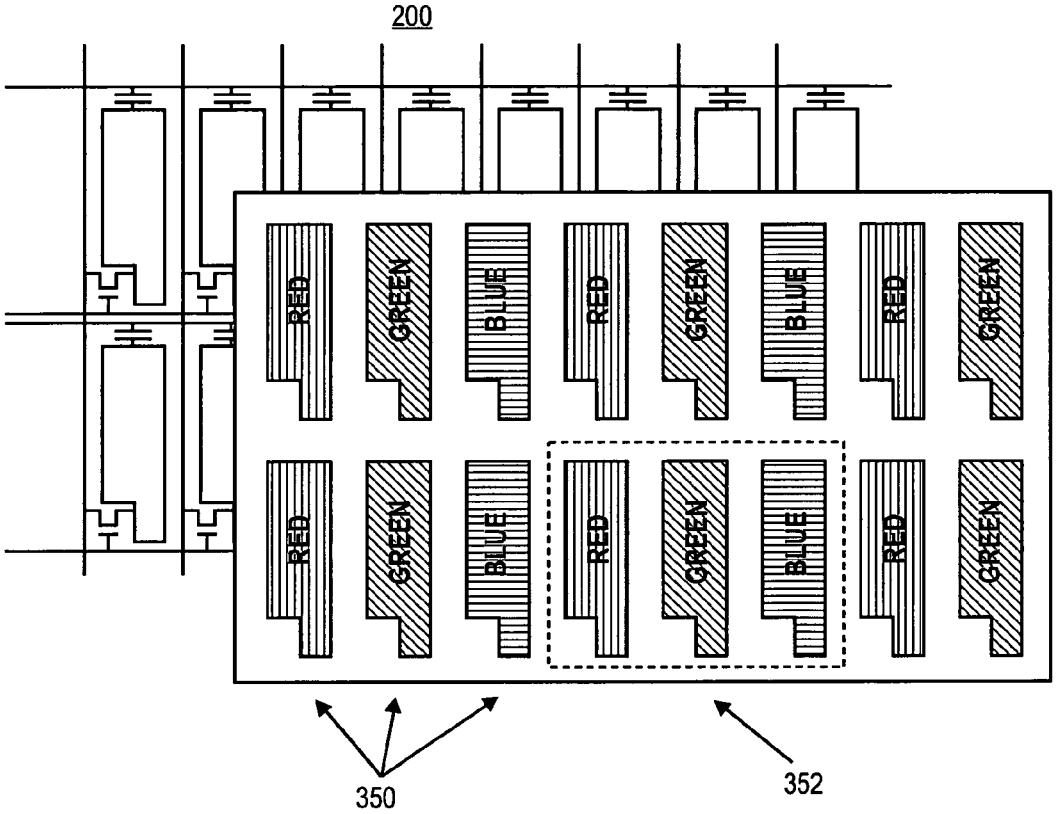

FIG. 2 is a block diagram illustrating a display 200 consistent with embodiments. Display 200 may be any type of video display capable of producing video by varying the transmission of light from a modulated light source viewable by a user. For example, display 200 may be an LCD. As illustrated in FIG. 2, display 200 includes a light source 202 and a display panel 204. For example, if display 200 is an LCD, light source 202 may be an LED or CCFL backlight as illustrated in FIGS. 3A and 3B, respectively. Further, if display 200 is an LCD, display panel 204 may be a liquid crystal panel as illustrated in FIG. 3C. Display 200 includes a buffer 206, a dithering circuit 208, a light source driver 210, and a control circuit 212.

Figure 4:
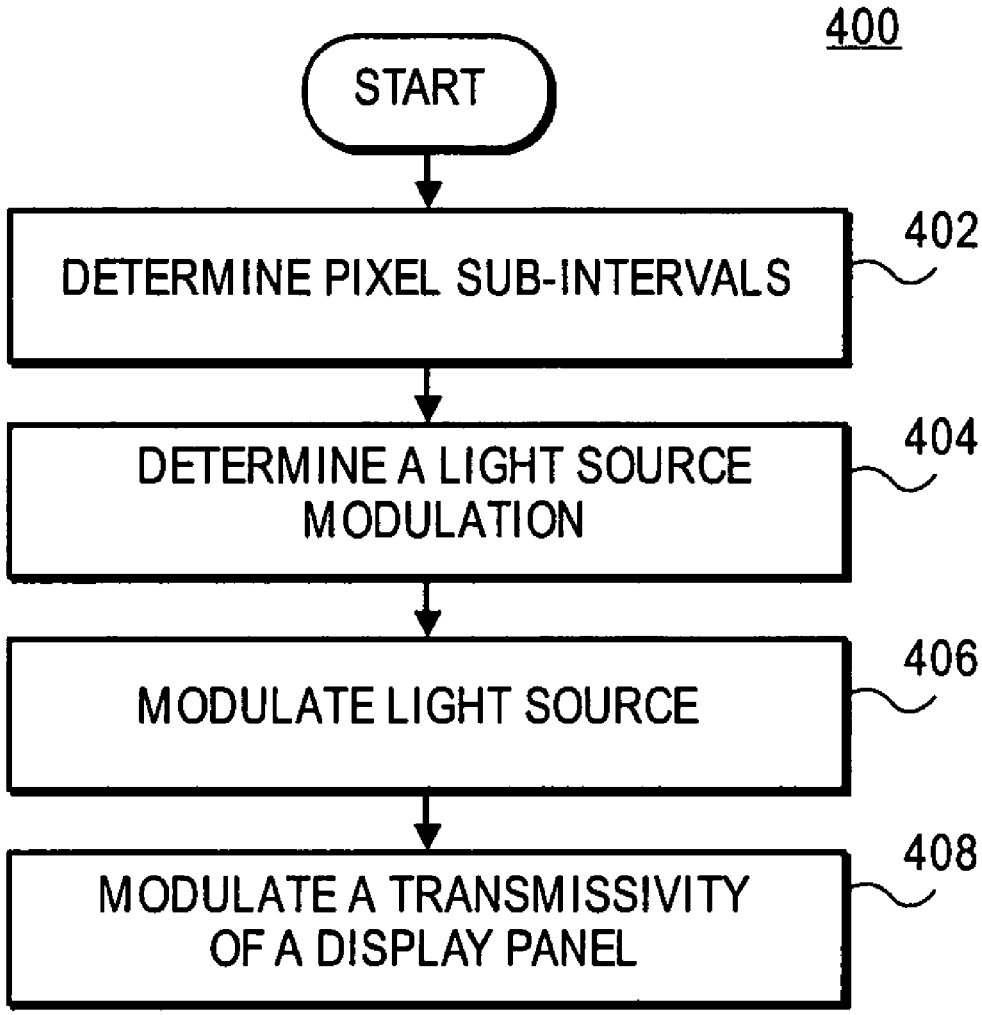
FIG. 4 is a flow chart illustrating a method of extending color depth consistent with embodiments.
Figure 5:
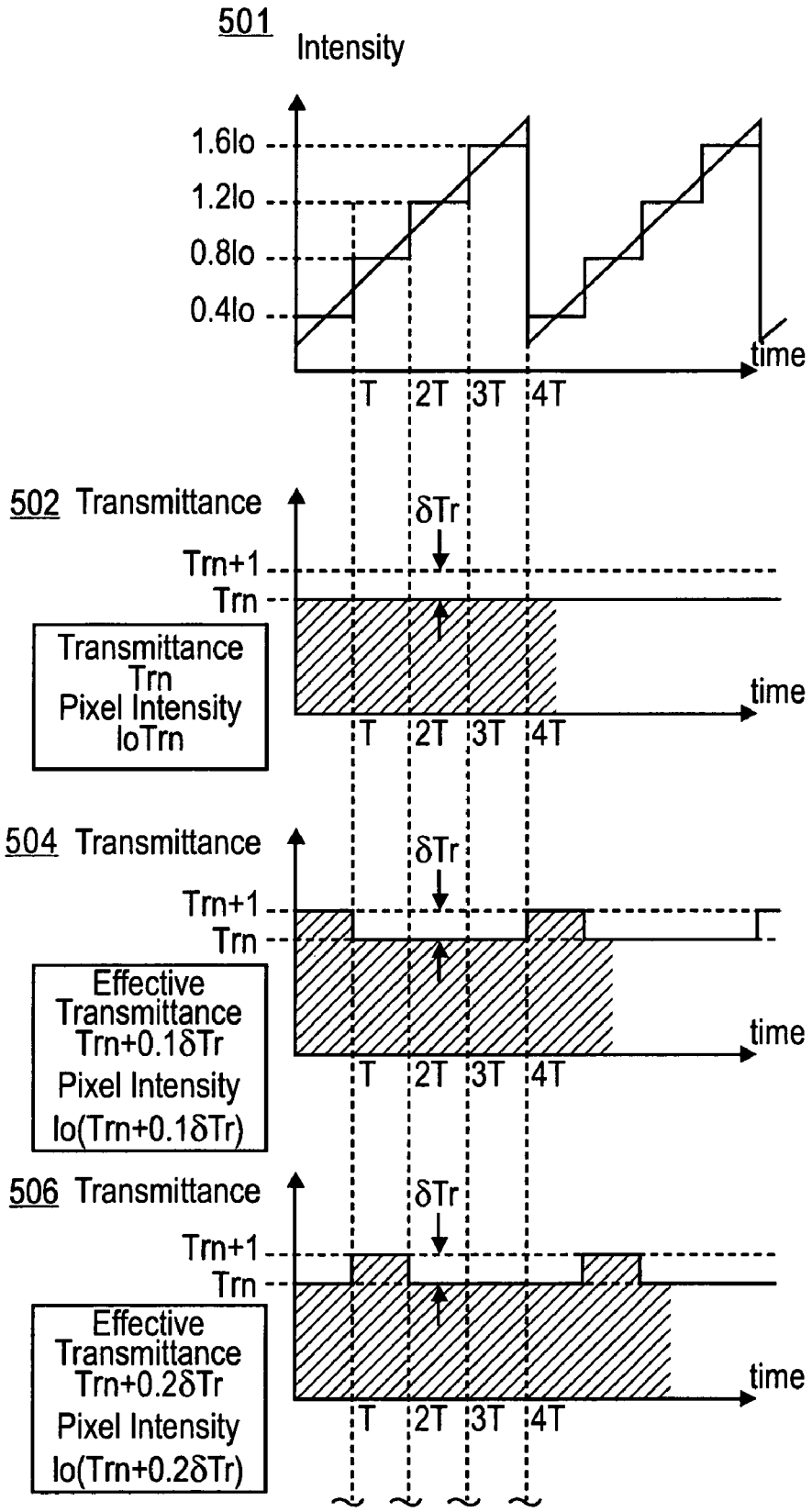
FIG. 5 is a diagram illustrating one example of the method of extending color depth consistent with embodiments.
Figure 5:
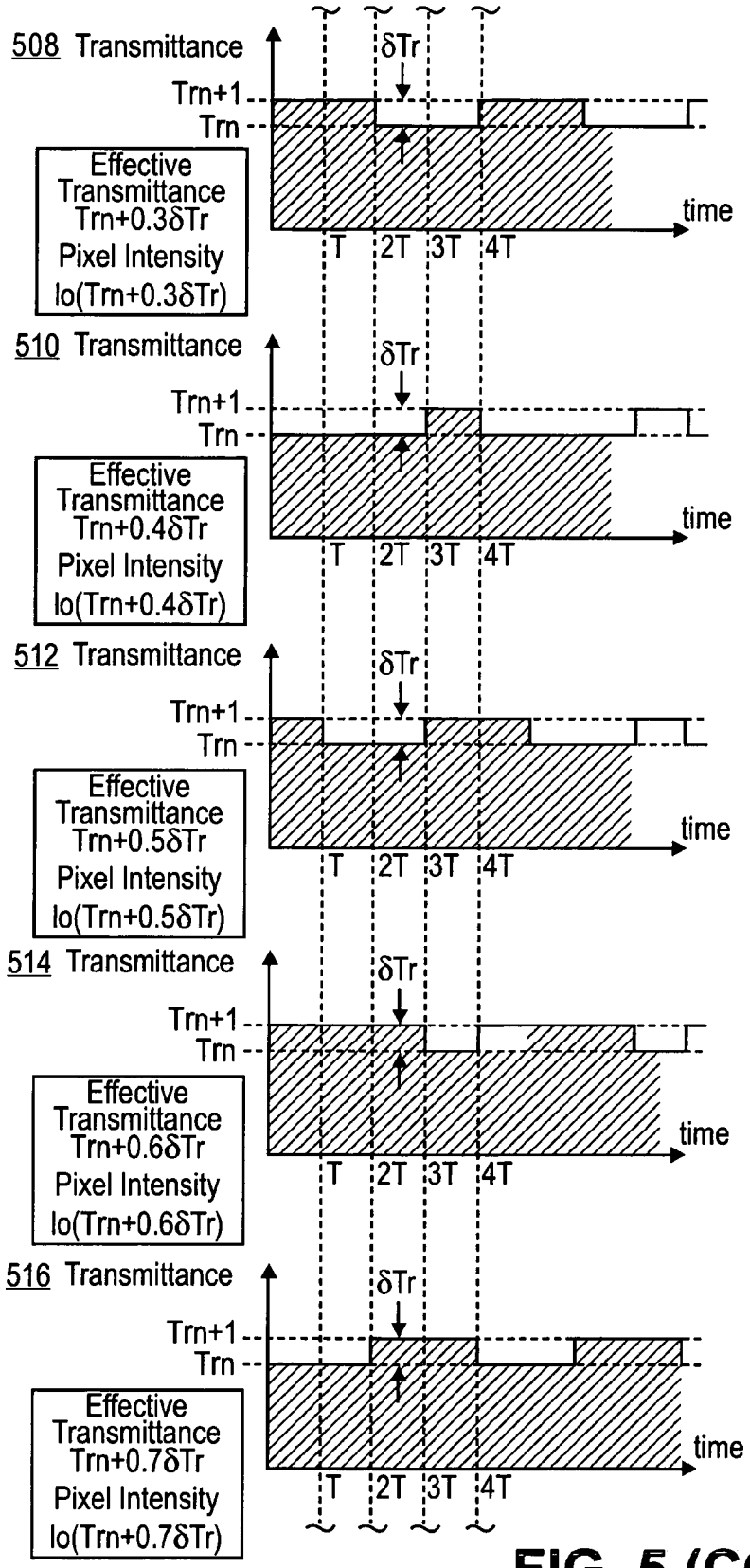
Figure 5:
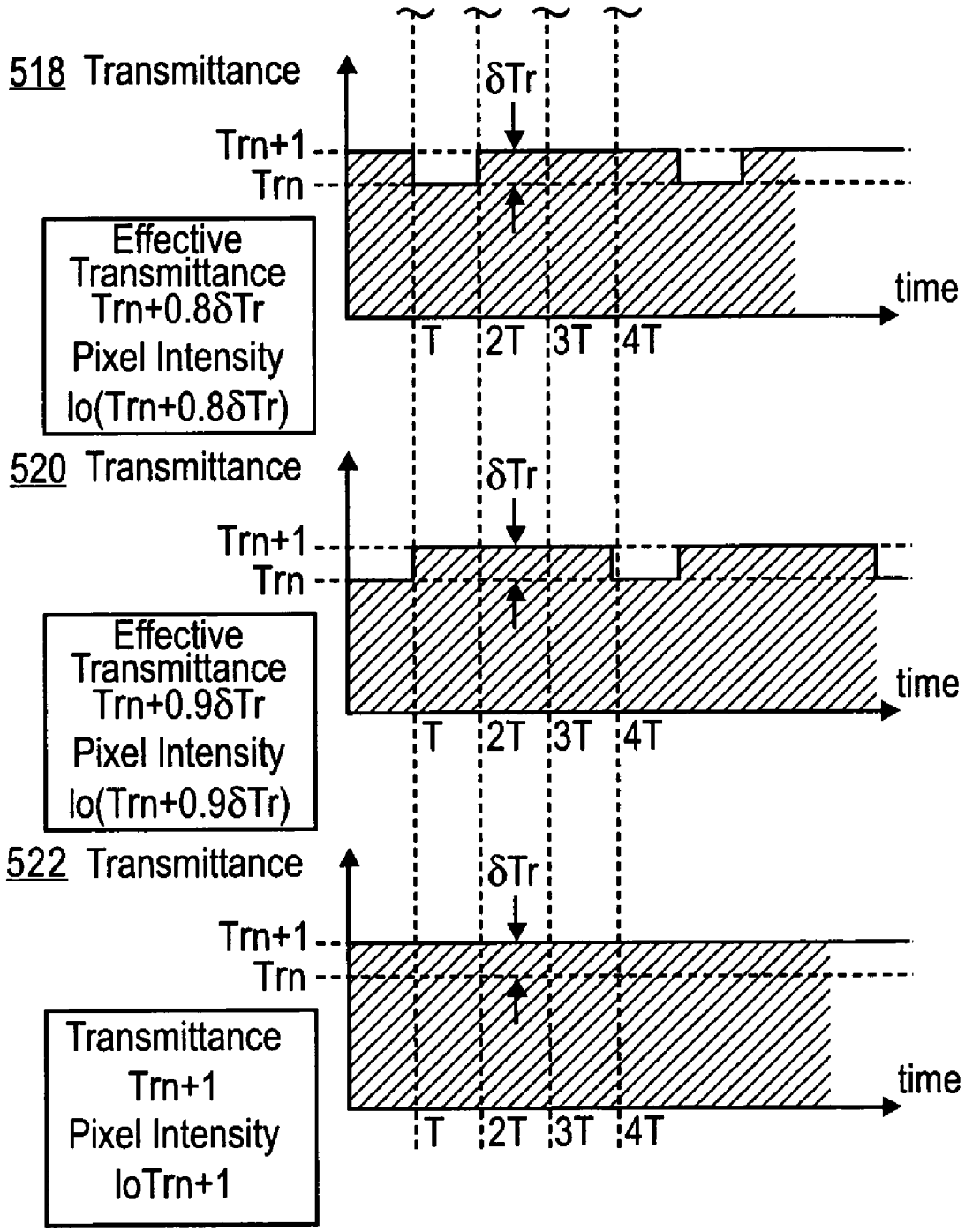
Figure 6:
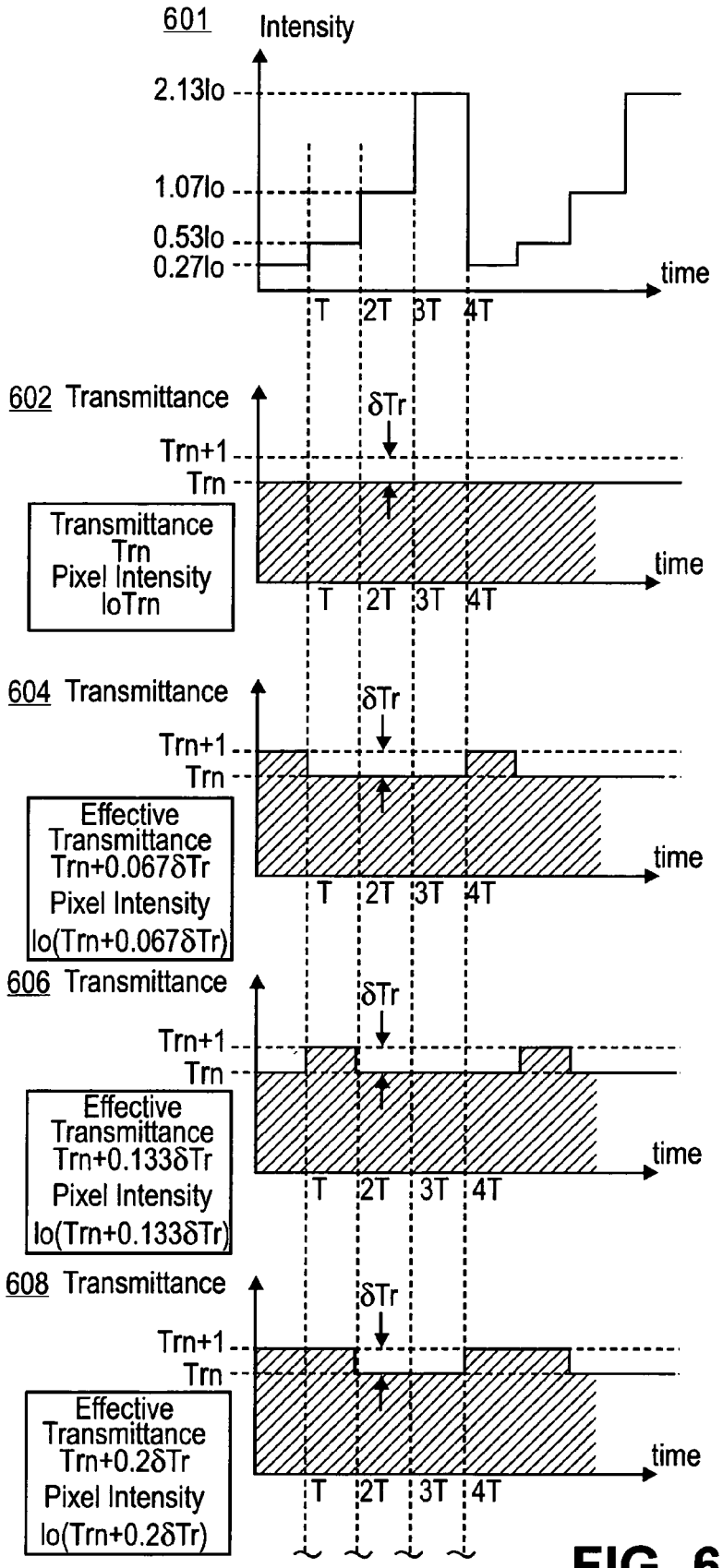
FIG. 6 is a diagram illustrating one example of the method of extending color depth consistent with embodiments.
Figure 6:
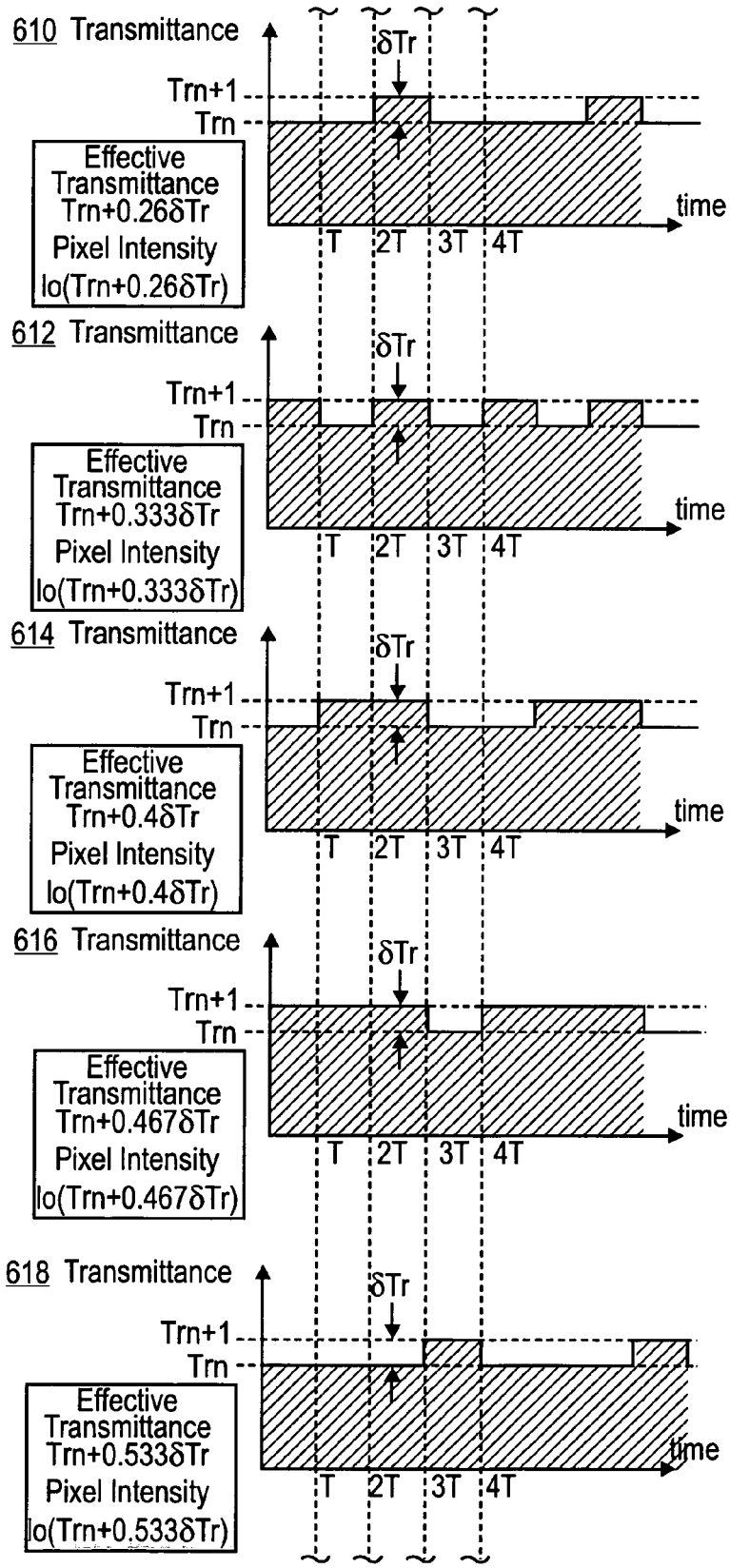
Figure 6:
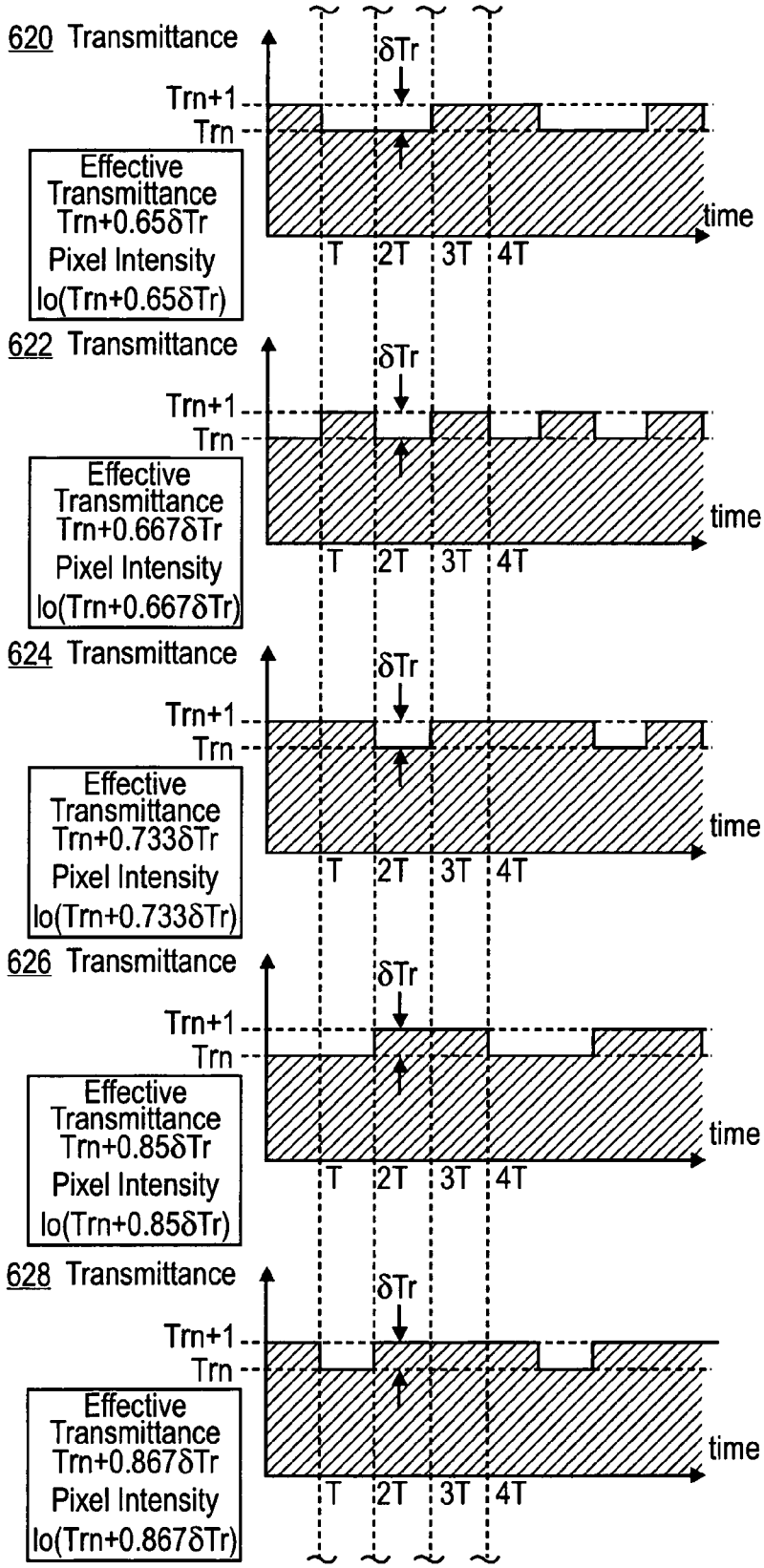
Figure 6:
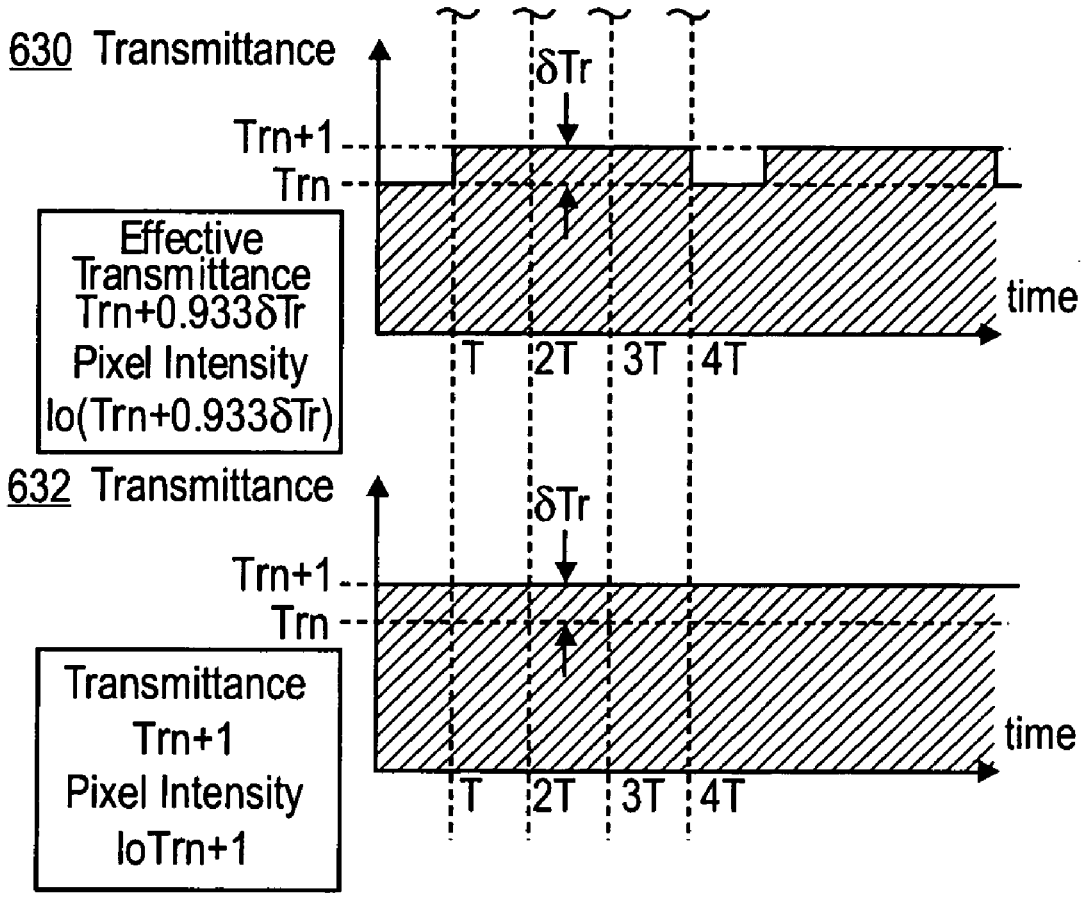

Buffer 206 is coupled to a video source (not shown) and coupled to dithering circuit 208. Display 200 receives a video signal at buffer 206. Buffer 206 buffers the video signal and passes the video signal to dithering circuit 208. Dithering circuit 208 performs the necessary processing to determine the modulation of light source 202. Further, dithering circuit 208 controls the dithering of display panel 204. Also, dithering circuit 208 synchronizes the modulation of light source 202 and the dithering of display panel 204 to create the video displayed on display 200 based on the video signal. FIGS. 4, 5, and 6 illustrates exemplary methods which may be performed by dithering circuit 208 consistent with embodiments.

Dithering circuit 208 may include any control and processing hardware, software, or combination thereof. For example, dithering circuit 208 may include a digital processor and memory coupled to the digital processor. In this example, the memory may contain the necessary logic to utilize the digital processor to control the light source driver and the display panel driver. For example, the memory may contain logic to determine pixel sub-intervals, determine light source modulation, generate a light source driver signal, and generate a display panel control signal.

Dithering circuit 208 is coupled to light source driver 210. Further, dithering circuit 108 is coupled to display panel driver 212. Dithering circuit 208 produces a control signal in order to control light source driver 210 to produce a modulated light source as determined by dithering circuit 208. Further, dithering circuit 208 produces a video signal which is passed to display panel driver 212. The video signal produced by dithering circuit 208 is synchronized with the modulated light source in order to generate the video to be displayed.

FIGS. 3A and 3B illustrated two types of light sources which may be used with display 200. FIG. 3A illustrates display 200 that utilizes LED backlighting. Display 200 includes an LED backlight panel 302 composed of LEDs 304. LEDs 304 may be monochrome. Also, LEDs 304 may be colored. For example, if LEDs 304 are colored, LEDs 304 are arranged in an alternating red, green, and blue pattern. Display 200 also includes a diffuser 306 situated between backlight panel 302 and LCD panel 308. LED backlight panel 302 creates an illumination 310 with a relatively structured intensity, but diffuser 306 transforms illumination 310 emitted from LED backlight panel into an illumination 312 with a practically uniform intensity. LCD panel 308 changes the transmittance of each individual LCD in LCD panel 308 based on a signal to produce an image 314 with a varied intensity.

FIG. 3B illustrates display 200 that utilizes CCFL backlighting. In FIG. 3B, display 200 includes a backlight panel 320 composed of CCFL tubes 322. CCFL tubes 322 may be arranged either vertically or horizontally. LCD 200 also includes a diffuser 324 situated between backlight panel 320 and LCD panel 328. Backlight panel 320 and diffuser 324 create an illumination 326 with a practically uniform intensity. LCD panel 328 changes the transmittance of each individual LCD in LCD panel 328 based on a signal to produce an image 330 with a varied intensity.

As mentioned above, LEDs 304 may be monochrome. Additionally, CCFL tubes 322 produce a monochrome light source. As such, display 200 may include a color filter in order to produce color video. FIG. 3C illustrates a color filter 350 which may be used with display 200 to produce colors and intensities as linear combination of the primary colors. As illustrated in FIG. 3C, color filter 350 includes alternating red, green, and blue color filters 352, each corresponding to a single LC cell. Varying color would be produced by changing the intensity of the three different color LC cells to produce different colors.

Figure 3D:
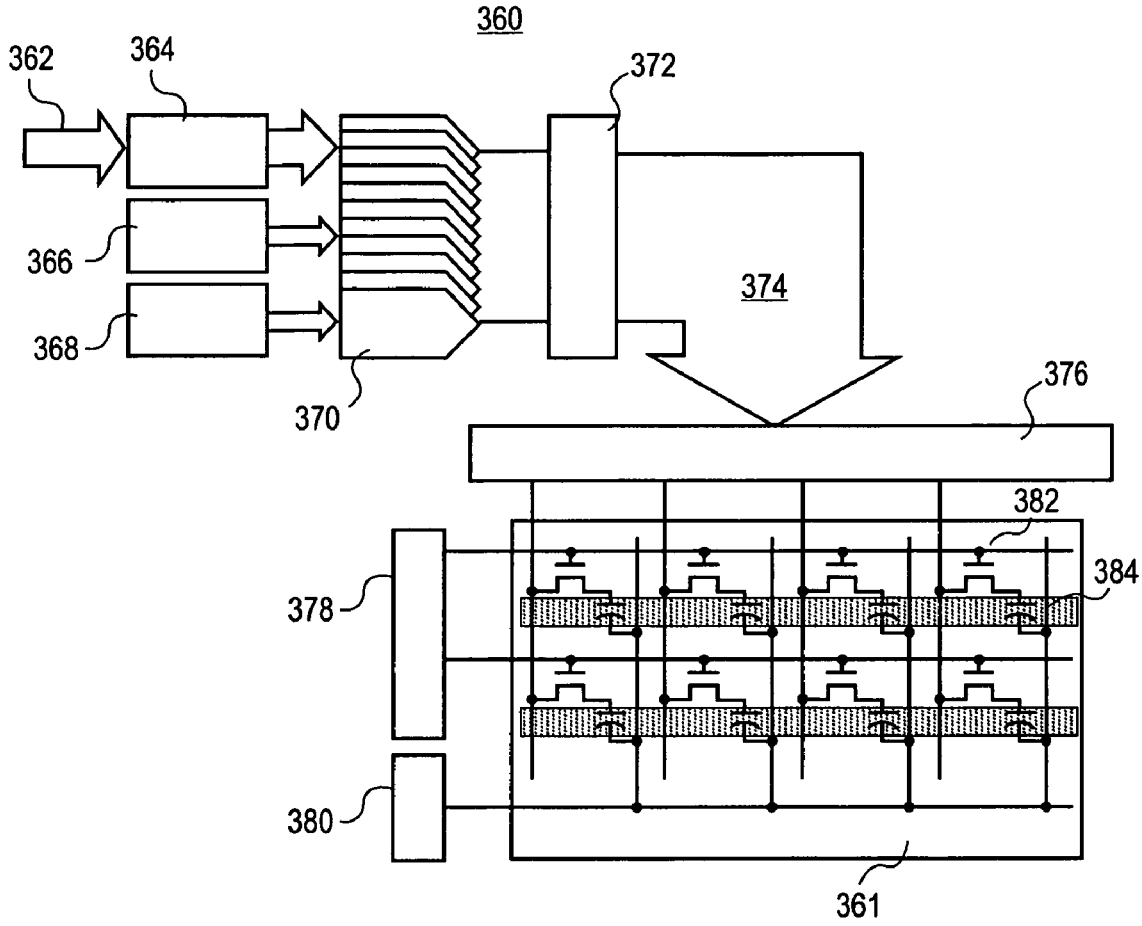

FIG. 3D illustrates a display panel and control circuit 360 which may be used as display panel 204 and control circuit 212 in display 200 consistent with embodiments. Display panel 360 includes a liquid crystal panel 361 which is made up of LC cells. An array of transistors 382 and capacitors 384 are attached to the LC cells. Display panel 204 receives a video signal 362 at interface 364. Interface 364 is coupled to DACs 370. DACs 370 via a non-linear look-up table or function generate voltages 374 which control the various LC cells. The voltage is strobed onto a local capacitor 384 via a local transistor 382 uniquely associated with that LC cell. Timing controller 366 is coupled to DACs 370 to provide a timing signal to DACs 370. Additionally, a power source 368 is coupled to DACs 370 to provide a reference voltage. The proper LC cell is selected using row selector 378 and column selector 376. Bias voltage source 380 provides a bias voltage to transistors 384.

FIG. 4 illustrates a method 400 for extending color depth in a display consistent with embodiments. Method 400 may be performed on any display in which a light source of the display may be modulated. For example, method 400 may be performed on display 200 illustrated in FIGS. 2 and 3A-D. Method 400 extends the color depth of the display by modulating the intensity of the light source for pixel sub-intervals. For example, if display 200 is used, individual LEDs or CCFL tubes of the backlight panel are modulated for sub-intervals of the pixel intervals.

Method 400 begins by determining the pixel sub-intervals in the pixels intervals (stage 402). The pixel sub-intervals are determined by dividing the pixel interval into a number of time period sub-intervals. The pixel interval may be divided into any number of sub-intervals that the display could produce. The number of sub-intervals may be determined based on the speed at which display cells can update. For example, the pixel interval may be divided into four pixel sub-intervals. One skilled in the art will realize that the pixel intervals may be divided into fewer or greater sub-intervals. If display 200 is used, dithering circuit 208 may determine the pixel sub-intervals.

Next, the display determines the modulation of the light source (stage 404). The light source modulation may be determined based on the video being display. Also, the light source modulation may be selected from a predetermined modulation pattern. The modulation pattern may be any type of function in which the intensity of the light source is changed for different pixel sub-intervals. For example, the modulation pattern may be a step wise function in which the intensity of the light source is increased for each sub-intervals of the pixel interval. One skilled in the art will realize that many patterns or functions may also be implemented for the light source modulation. If display 200 is used, dithering circuit 208 may determine the pixel sub-intervals and light source modulation.

Then, the display modulates the light source according to the determined light source modulation (stage 406). The light source may be modulated by altering the power delivered to the light source. For example, if display 200 is used, light source driver 210 may vary the power supplied to light source 202 based on the modulation received from dithering circuit 208.

Next, the display modulates the transmissivity of a display panel to produce the video (stage 408). The transmissivity of the display panel is modulated by changing the level of transmissivity of the display panel during the sub-intervals. The modulation of the transmissivity of the display panel is synchronized with the modulation of the light source to produce the desired video. For example, based on the video signal, the transmittance of the pixel in the display panel may be set to one of two consecutive levels of transmissivity. Since this dithering is synchronized with the modulation of the light source, the color depth that the display can achieve is increased. For example, if display 200 is used, control circuit 212 may control the transmissivity of display panel 204 based on the signal received from dithering circuit 208.

FIG. 5 illustrates an example of method 400 for extending color depth consistent with embodiments. This example of extending color depth may be performed on any display in which a light source of the display may be modulated. For example, this exemplary method may be performed on display 200 illustrated in FIGS. 2 and 3A-D. FIG. 5 illustrates the light source modulation for each pixel sub-interval (graphs 501) and the various LCD transmittance values during the pixel subintervals (graphs 502-522). In this example, pixel intervals are divided into four sub-intervals T, 2T, 3T, and 4T. In this example, the light source is modulated in a stepwise or linear saw tooth envelope synchronous with the four subintervals of the pixel interval. Specifically, the light source stepwise pattern is set to $0.4I_0$, $0.8I_0$, $1.2I_0$, and $1.6I_0$ for the pixel sub-intervals T, 2T, 3T, and 4T, respectively (graph 501). $I_0$ would be the uniform intensity of the light source if the light source was not modulated. For example, if display 200 is used, the LEDs or CCFL tubes of the backlight panel would be modulated.

To extend the color depth, the transmittance of the pixels in the display panel is to be driven by the output of a DAC either at the $Tr_n$ level or the next higher level $Tr_{n+1}$ with the separation being $\delta Tr$ (graphs 502-522). Transitions may only occur at the T, 2T, 3T, or 4T markers defining the four sub-intervals of the pixel intervals. The perceived or "effective" transmittance (and consequently luminosity) of a pixel will depend not only on how long the real transmittance of the cell of the display panel dwells at the $Tr_n$ and $Tr_{n+1}$ levels but also on when the corresponding levels are applied with regard to the light source intensity modulation.

The example illustrated in FIG. 5 provides nine additional grey shades per color, which correspond to the additional transmissivity contributions: $0.1I_0\delta Tr$ (graph 504), $0.2I_0\delta Tr$ (graph 506), $0.3I_0\delta Tr$ (graph 508), $0.4I_0\delta Tr$ (graph 510), $0.5I_0\delta$ (graph 512), Tr, $0.6I_0\delta Tr$ (graph 514), $0.7I_0\delta Tr$ (graph 516), $0.8I_0\delta Tr$ (graph 518), $0.9I_0\delta Tr$ (graph 520). Specifically, looking at graph 504, $Tr_{n+1}$ is applied for sub-interval T and $Tr_n$ is applied for sub-intervals 2T, 3T, and 4T. As a result, the effective transmittance for a given cell is $Tr_n+0.1\ \delta Tr$ and the pixel intensity is $I_0(Tr_n+0.1\delta Tr)$.

As a result of the light source modulation illustrated in FIG. 5, nine extra gray shades per color are generated which produces a de-facto increase in the display color depth from 256K to over 251 million colors. For an 8 bit DAC, the light source modulation illustrated in FIG. 5 produces a de-facto increase in the display color depth from 16 million colors to over 16 billion colors.

FIG. 6 illustrates another example of method 400 for extending color depth consistent with embodiments. This example of extending color depth may be performed on any display in which a light source of the display may be modulated. For example, this exemplary method may be performed on display 200 illustrated in FIGS. 2 and 3A-D. FIG. 6 illustrates the light source modulation for each pixel sub-interval (graph 601) and the various LCD transmittance values during the pixel subintervals (graphs 602-632). In this example, pixel intervals are divided into four sub-intervals T, 2T, 3T, and 4T. In this example, the light source is modulated in a stepwise envelope synchronous with the four sub-intervals of the pixel interval.

Specifically, the light source stepwise pattern is set to $0.27I_0$, $0.53I_0$, $1.07I_0$, and $2.13I_0$ for the pixel sub-intervals T, 2T, 3T, and 4T, respectively (graph 601). $I_0$ would be the uniform intensity of the light source if the light source was not modulated. In this example, the average of the intensity of the pixel interval would be $I_0$ $(0.27I_0+0.53I_0+1.07I_0+2.13I_0/4=I_0)$.

To extend the color depth, the transmittance of the pixel in the display panel is to be driven at the $Tr_n$ level or the next higher level $Tr_{n+1}$ with the separation being $\delta Tr$ (graphs 602-632). Transitions may only occur at the T, 2T, 3T, or 4T markers defining the four sub-intervals of the pixel intervals. The perceived or "effective" transmittance (and consequently luminosity) of a pixel will depend not only on how long the real transmittance of the cell of the display panel dwells at the $Tr_n$ and $Tr_{n+1}$ levels but also on when the corresponding levels are applied with regard to the light source intensity modulation.

The example illustrated in FIG. 6 provides fourteen additional grey shades per color, which correspond to the additional transmissivity contributions: $0.067I_0\delta Tr$ (graph 604), $0.133I_0\delta Tr$ (graph 606), $0.25I_0\delta Tr$ (graph 608), $0.267I_0\delta Tr$ (graph 610), $0.333I_0\delta Tr$ (graph 612), $0.4I_0\delta Tr$ (graph 614), $0.467I_0\delta Tr$ (graph 616), $0.533I_0\delta Tr$ (graph 618), $0.6I_0\delta Tr$ (graph 620), $0.687I_0\delta Tr$ (graph 622), $0.733I_0\delta Tr$ (graph 624), $0.8I_0\delta Tr$ (graph 626), $0.867I_0\delta Tr$ (graph 628), and $0.933I_0\delta Tr$ (graph 630). Specifically, looking at graph 604, $Tr_{n+1}$ is applied for sub-interval T and $Tr_n$ is applied for sub-intervals 2T, 3T, and 4T. As a result, the effective transmittance for a given cell is $Tr_n+0.067\delta Tr$ and the pixel intensity is $I_0(Tr_n+0.067\delta Tr)$.

As a result of the light source modulation illustrated in FIG. 6, fourteen extra gray shades per color are generated which produces a de-facto increase in the display color depth from 256K to over 846 million colors. For an 8 bit DAC, the light source modulation illustrated in FIG. 6 produces a de-facto increase in the display color depth from 16 million to over 56 billion.

One skilled in the art will realize that the methods illustrated in FIGS. 5 and 6 are exemplary and that many other different patterns may also be implemented for the light source modulation and that many different sub-interval division may be implemented. For example, the pixel intervals may be divided into fewer or greater sub-intervals. Further, different patterns and intensity levels for the light source modulation may be applied during the sub-intervals.

Further, the intensity patterns illustrated in graphs 501 and 601 of FIGS. 5 and 6 are merely exemplary. In the methods of FIGS. 5 and 6, the illustrated intensity levels may be applied in a different pattern. In the methods of FIGS. 5 and 6, the intensity level for any sub-interval may be used in any other sub-interval.

Other embodiments will be apparent to those skilled in the art from consideration of the specification and practice of the invention disclosed herein. It is intended that the specification and examples be considered as exemplary only, with a true scope and spirit of the invention being indicated by the following claims.

What is claimed is:

1. A display with extended color depth, comprising:
- a light source;
- a light source driver coupled to the light source;
- a transmissive display panel disposed adjacent to the light source;
- a display panel control circuit coupled to the display panel; and
- a dithering circuit coupled to the light source driver and display panel control circuit, the dithering circuit comprising:
  - logic for determining pixel sub-intervals for pixel intervals in a video signal, logic for modulating a transmissivity of the display panel from one sub-interval to another sub-interval, and logic for modulating light source intensity from the one sub-interval to the another sub-interval.

2. The display of claim 1, wherein the dithering circuit further comprises:
- logic for synchronizing the modulating the light source intensity from one sub-interval to the another sub-interval and the modulating the transmissivity of the display panel from the one sub-interval to the another sub-interval.

3. The display of claim 2, wherein the light source driver further comprises:
- logic for modulating the intensity of the light source stepwise between the sub-intervals of each pixel interval.

4. The display of claim 2, wherein the logic for synchronizing comprises:
- logic for receiving a desired output of a pixel for a pixel interval; and
- logic for determining a modulation of the light source intensity.

5. The display of claim 4, wherein the logic for synchronizing, further comprises:
- logic for determining a modulation of the transmissivity of the pixel; and
- logic for synchronizing the determined modulation of the transmissivity of the pixel with the modulation of the light source intensity to produce the desired output.

6. The display of claim 5, wherein the display further comprises:
- logic for powering the light source based on the modulation of the light source; and
- logic for setting transmissivity of the pixel based on the determined modulation of the transmissivity of the pixel.

7. A method of extending color depth in a display, comprising:
- determining pixel sub-intervals for pixel intervals in a video signal;
- modulating a transmissivity of a display panel of the display from one sub-interval to another sub-interval and in synchronization with the determined pixel sub-intervals; and
- modulating backlight intensity of a backlight from the one sub-interval to the another sub-interval and in synchronization with the determined pixel sub-intervals.

8. The method of claim 7, further comprising synchronizing the modulating the backlight intensity from one sub-interval to the another sub-interval and the modulating the transmissivity of the display panel from the one sub-interval to the another sub-interval.

9. The method of claim 8, wherein the backlight intensity is modulated step-wise between the sub-intervals of each pixel interval.

10. The method of claim 8, wherein the backlight intensity is modulated between sub-intervals such that an average of an intensity for the pixel interval is equal to an equivalent uniform backlight intensity.

11. The method of claim 8, wherein the backlight intensity is modulated in a binary pattern between sub-intervals.

12. The method of claim 8, wherein synchronizing the modulating the backlight intensity from one sub-interval to the another sub-interval and the modulating the transmissivity of the display panel from the one sub-interval to the another sub-interval, comprises:
- receiving a desired output of a pixel for a pixel interval;
- determining a modulation of the backlight intensity; and
- determining a modulation of the transmissivity of the pixel, wherein the modulation of the transmissivity is synchronized with the modulation of the backlight intensity to produce the desired output.

13. The method of claim 12, further comprising:
- powering the backlight based on the determined modulation of the backlight intensity; and
- setting the transmissivity of the pixel based on the determined modulation of the transmissivity of the pixel.

14. A method of extending color depth in a display, comprising:

determining pixel sub-intervals for pixel intervals in a video signal;

determining a light source modulation for the pixel sub-intervals;

modulating intensity of a light source based on the light source modulation; and synchronizing a transmittance of a display panel of the display with the light source modulation for each sub-interval.

15. The method of claim 14, wherein the light source modulation is step-wise between the sub-intervals of each pixel interval.

16. The method of claim 14, wherein the light source intensity is modulated between sub-intervals such that an average of an intensity for the pixel intervals is equal to an equivalent uniform light source intensity.

17. The method of claim 14, wherein the light source modulation is modulated in a binary pattern between sub-intervals.

18. The method of claim 14, further comprising:

receiving a desired output of a pixel of the display panel for a pixel interval; and determining the light source modulation based on the received desired output.

19. The method of claim 18, further comprising:

determining a modulation of the transmissivity of the pixel, wherein the modulation of the transmissivity is synchronized with the light source modulation to produce the desired output.

20. The method of claim 19, further comprising:

powering the light source based on the light source modulation; and setting transmissivity of the pixel based on the determined modulation of the transmissivity of the pixel.

* * * * *